US009217572B2

(12) United States Patent
Park et al.

(10) Patent No.: US 9,217,572 B2
(45) Date of Patent: Dec. 22, 2015

(54) BURNER CAP AND BURNER

(71) Applicant: LG ELECTRONICS INC., Seoul (KR)

(72) Inventors: Janghee Park, Seoul (KR); Sangcheol Lee, Seoul (KR); Jaebeom Lim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 129 days.

(21) Appl. No.: 14/011,783

(22) Filed: Aug. 28, 2013

(65) Prior Publication Data

US 2014/0190468 A1 Jul. 10, 2014

(30) Foreign Application Priority Data

Jan. 10, 2013 (KR) ..... 10-2013-0002787

(51) Int. Cl.
*F24C 3/08* (2006.01)
*F23D 14/06* (2006.01)

(52) U.S. Cl.
CPC ..... *F24C 3/085* (2013.01); *F23D 14/06* (2013.01); *F23D 2900/14061* (2013.01); *F23D 2900/14062* (2013.01); *F23D 2900/14064* (2013.01)

(58) Field of Classification Search
CPC ..... F24C 3/085; F23D 14/06
USPC ..... 126/39 E, 39 R, 39 K; 431/354, 258
See application file for complete search history.

(56) References Cited

U.S. PATENT DOCUMENTS

| | | | | |
|---|---|---|---|---|
| 6,132,205 | A * | 10/2000 | Harneit | 431/354 |
| 2002/0034713 | A1* | 3/2002 | Harneit et al. | 431/266 |
| 2004/0029063 | A1* | 2/2004 | Bettinzoli | 431/354 |
| 2010/0206293 | A1* | 8/2010 | Padgett et al. | 126/39 E |

* cited by examiner

*Primary Examiner* — Avinash Savani
(74) *Attorney, Agent, or Firm* — Ked & Associates, LLP

(57) ABSTRACT

A burner cap and a burner are provided. The burner cap may include a cap body, an opening formed in the cap body, at a location separated from an edge of the cap body, proximate the center of the cap body, a distribution protrusion formed on a bottom part of the cap body, and a connection guide formed on the distribution protrusion.

12 Claims, 5 Drawing Sheets

BURNER CAP AND BURNER

CROSS-REFERENCE TO RELATED APPLICATION(S)

This application claims priority under 35 U.S.C. §119 to Korean Application No. 10-2013-0002787 filed on Jan. 10, 2013, whose entire disclosure is hereby incorporated by reference.

BACKGROUND

1. Field

This relates to a burner cap and a burner.

2. Background

A burner may directly heat a material for cooking or a container containing the material using flames/heat generated by combustion of gas. Such a burner may include a burner head, a burner cap covering the burner head, and an injection device injecting gas into the burner head. The burner head may include a supply pipe into which a mixture of the gas injected from the injection device and air flows and is burned at a burner port formed around the burner head. When the mixture gas is intensively supplied to a burner port close to the supply pipe in such that flames may be concentrated or a large amount of carbon monoxide generated due to incomplete combustion. Accordingly, heat may not be uniformly provided to the object and/or an accident may be caused.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to various embodiments, examples of which are illustrated in the accompanying drawings.

In the following detailed description, reference is made to the accompanying drawings that form a part hereof, and in which is shown by way of illustration various embodiments. These embodiments are described in sufficient detail to enable those skilled in the art, and it is understood that other embodiments may be utilized and that logical structural, mechanical, electrical, and chemical changes may be made without departing from the spirit or scope as broadly described herein. To avoid detail not necessary to enable those skilled in the art, the description may omit certain information known to those skilled in the art. The following detailed description is, therefore, not to be taken in a limiting sense.

Figure 1:
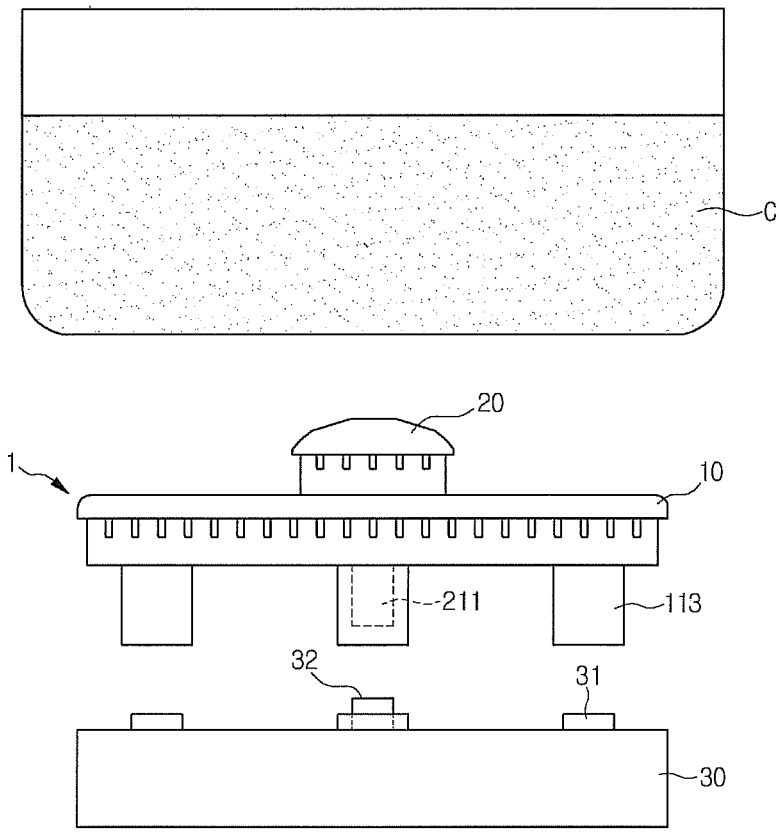
FIG. 1 illustrates a burner according to an embodiment as broadly described herein.
Figure 2:
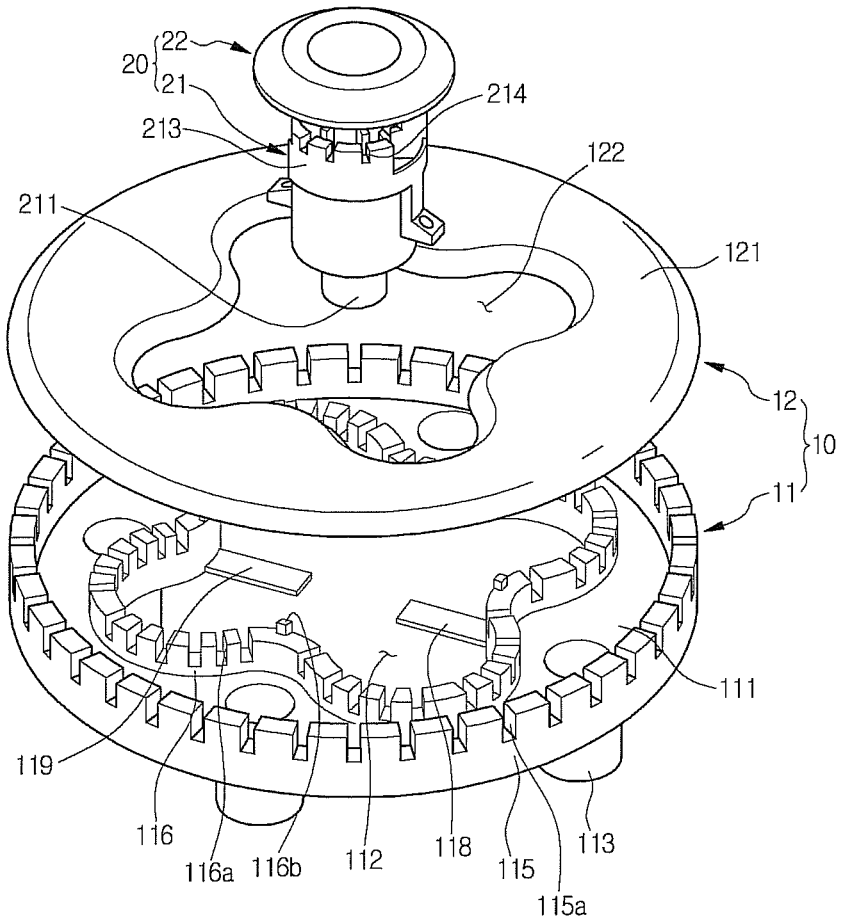
FIG. 2 is an exploded perspective view of a burner according to an embodiment as broadly described herein.
Figure 3:
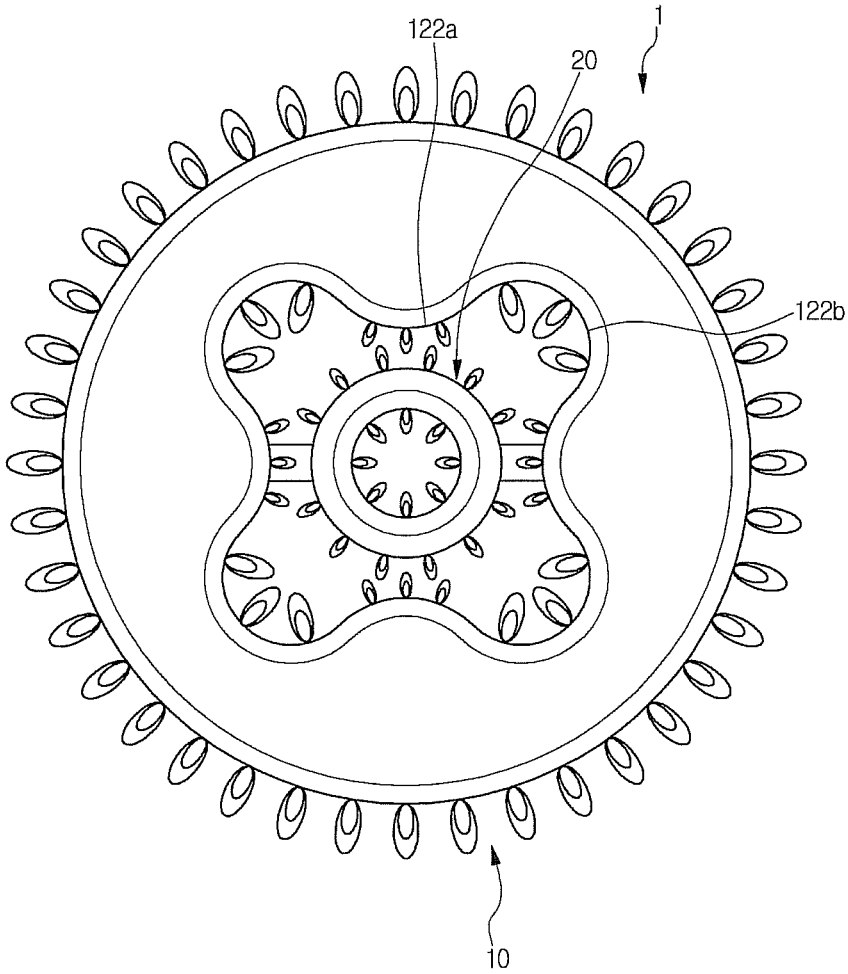
FIG. 3 illustrates a flame distribution pattern of the burner shown in FIGS. 1 and 2.

Referring to FIGS. 1 to 3, the burner 1 as embodied and broadly described herein may include a first burner 10, a second burner 20 seated on the first burner 10, and an injection device 30 for supplying gas to the first burner 10 and/or the second burner 20.

The first burner 10 may include a first burner head 11 and a first burner cap 12 covering the first burner head 11. The first burner head 11 may include a burner base 111 having a first opening 112 formed therein. The burner base 111 may include one or more first mixture pipes 113 to guide a mixture gas including gas and air. For example, as shown in FIG. 2, the burner base 111 may include four first mixture pipes 113. However, in the present embodiment, the number of first mixture pipes is not limited thereto.

A head supporting wall 115 may be formed on an edge of the burner base 111, to support the first burner cap 12. The head supporting wall 115 may protrude upwards from the edge of the burner base 111. The head supporting wall 115 may be continuously formed along the edge of the burner base 111. That is, the head supporting wall 115 may form a closed loop. The head supporting wall 115 may include a plurality of first burner ports 115*a*.

A head inner wall 116 may be formed inside the head supporting wall 115, and may include a plurality of second burner ports 116*a*. That is, the head inner wall 116 may be separated from the head supporting wall 115 and may be located closer to the center of the burner base 111 than the head supporting wall 115. The head inner wall 116 may protrude upwards from a part where the first opening 112 of the burner base 111 is formed. The first burner cap 12 may be seated on the head inner wall 116. The head inner wall 116 may be formed in a shape corresponding to the first opening 112.

A fastening protrusion 116*b* for fastening the first burner cap 12 may be formed on the head inner wall 116.

The first mixture pipe 113 may be formed on a part corresponding to a space between the head supporting wall 115 and the head inner wall 116. That is, the mixture gas flowing through the first mixture pipe 113 may be supplied to a flow space between the head supporting wall 115 and the head inner wall 116.

In a top view of the first burner head 11, the head supporting wall 115 may be formed to be substantially circular and the head inner wall 116 may be formed to be noncircular.

On the first opening 112 of the burner base 111, one or more supporting parts 118 and 119 may be formed to support the second burner 20. For example, as shown in FIG. 2, two supporting parts 118 and 119 may be formed on the burner base 111. However, in the present embodiment, the number of supporting parts is not limited thereto.

The first burner cap 12 may include a cap body 121 and a second opening 122 formed in a shape corresponding to the first opening 112 of the first burner head 11. The second opening 122 may be substantially the same size as the first opening 112 or smaller. An area of the second opening 122 may be smaller than an area formed by the head inner wall 116. Also, the center of the first burner cap 12 may pass through the first opening 112 and the second opening 122. That is, the second opening 122 may be formed in a central part of the cap body 121. In this case, the second opening 122 may be formed in a location separated from an edge of the cap body 121 toward the central part of the cap body 121.

In detail, an edge part forming the second opening 122 may include a first edge part 122*a* and a second edge part 122*b*. A distance between the first edge part 122*a* and the center of the second opening 122 of the first burner cap 12 is shorter than a distance between the second edge part 122*b* and the center of the second opening 122 of the first burner cap 12. In the present embodiment, a plurality of first edge parts 122*a* and a plurality of second edge parts 122*b* may be alternately arranged.

The head inner wall 116 may be formed in a shape corresponding to the second opening 122. Accordingly, the head inner wall 116 may include a first part and a second part having substantially the same shapes as the first edge part 122*a* and the second edge part 122*b* of the second opening 122. Accordingly, a distance between the first part of the head inner wall 116 and the center of the first opening 112 may be smaller than a distance between the second part and the center of the first opening 112.

The second burner 20 may include a second burner head 21 and a second burner cap 22 covering the second burner head 21. The second burner head 21 may include a second mixture pipe 211 forming a flow path for the mixture gas, a supporting wall 213 supporting the second burner cap 22 and formed with a plurality of third burner ports 214, and one or more coupling parts to be coupled with the supporting parts 118 and 119 of the first burner head 11. The second burner 20 may pass through the second opening 122 and may be seated on the supporting parts 118 and 119. A part of the second burner 20 seated on the supporting parts 118 and 119 may penetrate the first opening 112.

The injection device 30 may inject gas to the first burner 10, or to both the second burner 20 below the first burner 10 and the second burner 20. The injection device 30 may include one or more first nozzles 31 to inject the gas to the first burner 10 and a second nozzle 32 to supply the gas to the second burner 20. The first nozzles 31 may be separated from the first mixture pipe 113 of the first burner 10 and aligned with the first mixture pipe 113. The second nozzles 32 may be separated from the second mixture pipe 211 of the second burner 20 and aligned with the second mixture pipe 211.

The injection device 30 may inject gas to only one of the first burner 10 or the second burner 20, or may inject gas to both the first burner 10 and the second burner 20 at the same time.

The mixture gas injected into the first burner 10 collides with a bottom surface of the first burner cap 12 and is discharged toward the first burner ports 115*a* and the second burner ports 116*a* formed inside and outside the first burner head 11. The discharged mixture gas is ignited by an ignition device and forms flames outside and inside of the first burner head 11, as shown in FIG. 3. Similarly, the mixture gas injected into the second burner 20 is discharged toward the outside and inside of the second burner head 21 and ignited, thereby forming flames outside and inside the second burner head 21.

Figure 4:
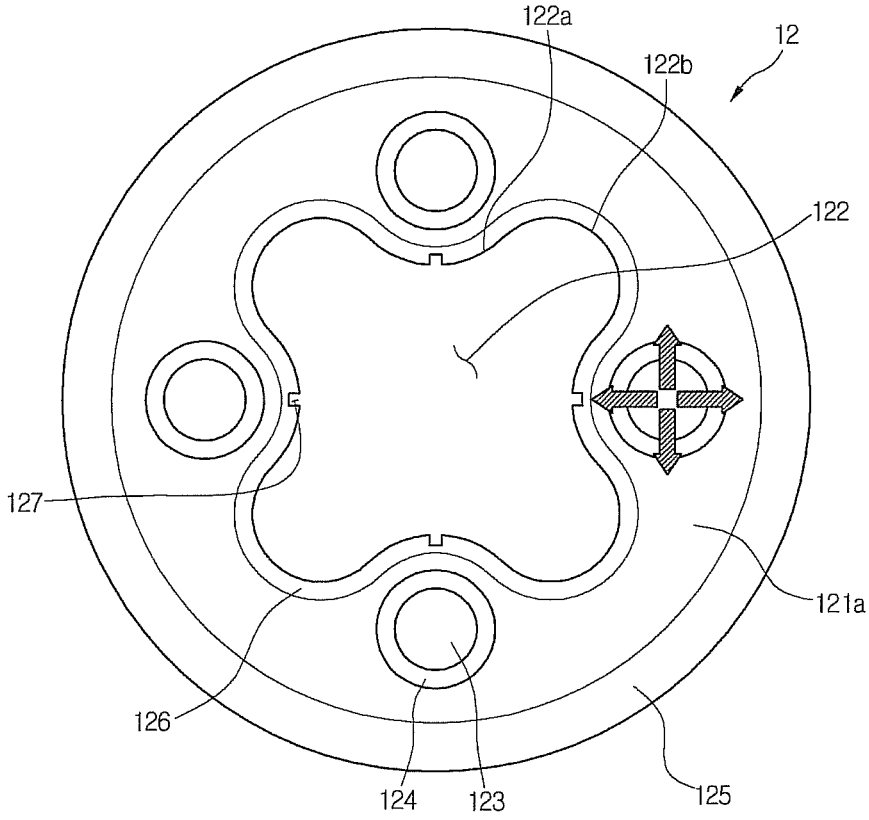
FIG. 4 is a bottom view of a first burner cap according to an embodiment as broadly described herein.

Referring to the bottom view of the first burner cap 12 shown in FIG. 4, the first burner cap 12 may include a bottom part 121*a*, or a bottom plate 121*a*, a cap outer wall 125 formed outside the bottom part 121*a*, a cap inner wall 126 formed separated from the cap outer wall 125, a distribution protrusion 123 formed between the cap outer wall 125 and the cap inner wall 126, and a connection guide 124 that protrudes from the distribution protrusion 123. The bottom part 121*a* may define an inflow space together with the burner base 111, the head supporting wall 115, and the head inner wall 116.

The cap outer wall 125 may protrude downwards from the bottom part 121*a*. The cap outer wall 125 may be supported by the head supporting wall 115. The cap outer wall 125 may be substantially circular corresponding to the head supporting wall 115. However, a shape of the cap outer wall 125 is not limited thereto.

The cap inner wall 126 may be formed inside the cap outer wall 125 to be separated therefrom. The cap inner wall 126 may protrude downwards in a shape corresponding to the second opening 122. The cap inner wall 126 may be non-circular corresponding to the head inner wall 116.

The cap inner wall 126 may be supported by the head inner wall 116. On the cap inner wall 126, a fastening groove 127 may be formed to contain the fastening protrusion 116*b*. The first burner cap 12 may be fastened to the first burner head 11 by coupling between the fastening protrusion 116*b* and the fastening groove 127.

In the present embodiment, the fastening protrusion 116*b* and the fastening groove 127 are formed on the head inner wall 116 and the cap inner wall 126, respectively, but are not limited thereto, and instead may be formed on the cap outer wall 125 and the head supporting wall 115, respectively.

The distribution protrusion 123 may be formed at a location corresponding to the first mixture pipe 113. When the burner cap 12 is seated on the burner head 11, the distribution protrusion 123 may be located above the first mixture pipe 113. When the first mixture pipe 113 is provided in a plurality thereof, the distribution protrusion 123 may be provided in plurality. Accordingly, the respective distribution protrusions 123 may also be formed at locations respectively corresponding to the respective first mixture pipes 113.

The distribution protrusion 123 may protrude downwards from the bottom part 121*a* between the cap outer wall 125 and the cap inner wall 126. In other words, when the first burner head 11 and the first burner cap 12 are coupled with each other, a height of the distribution protrusion 123 may be formed to be smaller than the bottom part 121*a* with respect to the burner base 111.

The distribution protrusion 123 may be substantially cylindrical. However, a shape of the distribution protrusion 123 is not limited thereto, and a cross section of the distribution protrusion 123 may be, for example, polygonal.

For example, a diameter of the distribution protrusion 123 or a length between left and right sides thereof may be greater than a diameter of the first mixture pipe 113. That is, the entire first mixture pipe 113 may overlap the distribution protrusion 123 in a vertical direction.

The distribution protrusion 123 may be formed farther from the center of the cap body 121 than the first edge part 122*a*. In other words, the distribution protrusion 123 may be provided between the first edge part 122*a* and an outer edge of the bottom part 121*a*. Also, the distribution protrusion 123 may be formed closer to the center of the cap body 121 than the second edge part 122*b*, and the distribution protrusion 123 may be formed between two adjacent second parts 122*b*.

An end of the distribution protrusion 123 may be oriented vertically with respect to a flow direction of the mixture gas flowing from the first mixture pipe 113.

The distribution protrusion 123 may be formed as a single body together with the first burner cap 12, or may be manufactured as an additional component to be attached to the first burner cap 12.

The connection guide 124 may protrude downwards from the distribution protrusion 123. In other words, with the bottom part 121*a* as a reference, a distance to the end of the distribution protrusion 123 may be longer than a distance to an end of the connection guide 124. In other words, it may be understood that the distribution protrusion 123 is depressed upwards from a bottom and forms a depression space in a central part and the connection guide 124 is formed outside the depression space.

The bottom of the distribution protrusion 123 may be substantially flat. The connection guide 124 may extend from the distribution protrusion 123 in a vertical direction. The connection guide 124 may be provided as a mutually connected shape. The connection guide 124 may be continuously formed along an edge of the end of the distribution protrusion 123. That is, the connection guide 124 may form a loop.

The connection guide 124 may correspond to the shape of the distribution protrusion 123. The connection guide 124 may be formed as a circular ring or a polygonal ring. The connection guide 124 may be formed as a single body together with the distribution protrusion 123, or may be manufactured as an additional component to be attached to the distribution protrusion 123.

Figure 5:
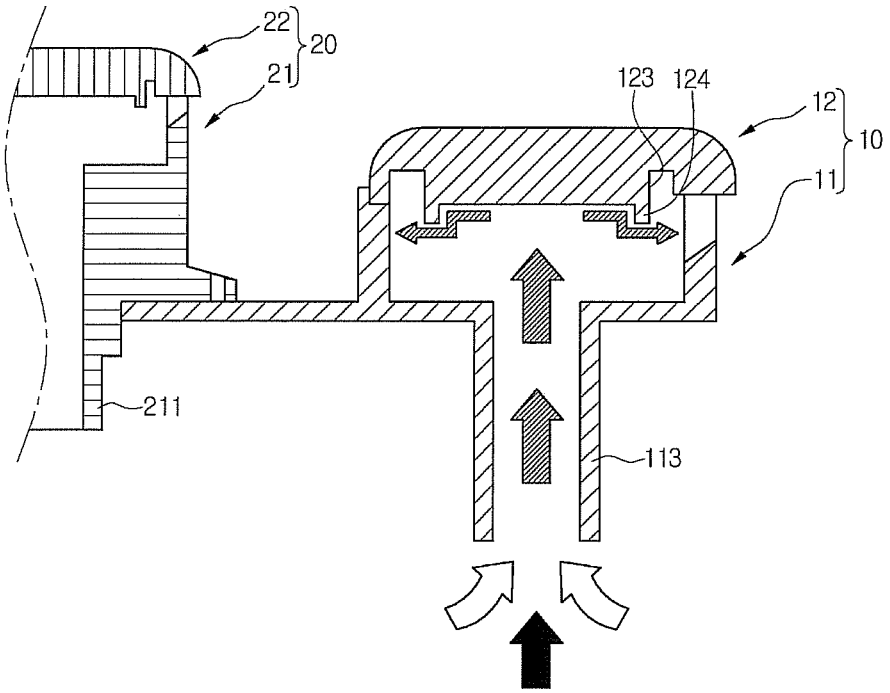
FIG. 5 is a partial cross-sectional view of the burner shown in FIGS. 1 and 2.

Operation of the burner 1 will be described with reference to the partial cross sectional view of the burner 1 shown in FIG. 5.

When a user operates the burner 1, a valve for controlling gas supplied to the injection device 30 is open and the gas is supplied to the injection device 30. The supplied gas is sprayed by the nozzles 31 and 32 at high speed toward the respective mixture pipes 113 and 211.

Since the nozzles 31 and 32 and the respective mixture pipes 113 and 211 are arranged separated from one another, during a process in which the gas is injected from the nozzles 31 and 32 to the respective mixture pipes 113 and 211, air around the mixture pipes 113 and 211 is sucked into the mixture pipes 113 and 211, and the air and the gas are mixed with each other in the mixture pipes 113 and 211.

In the case of a flow of the mixture gas in the first burner 10, mixed air and gas in the first mixture pipe 113 is supplied to the flow space between the head supporting wall 115 and the head inner wall 116. The mixture gas in the flow space is discharged toward the outside of the first burner head 11 through the plurality of first burner ports 115*a* and is discharged toward the center of the first burner head 11 through the plurality of second burner ports 116*a*. The discharged mixture gas is ignited by the ignition device, which may be operated by an operator. Accordingly, a container C (see FIG. 1) may be heated by flames generated due to combustion of the mixture gas, thereby cooking an object for cooking.

In detail, the mixture gas injected through the first mixture pipe 113 collides with the end of the distribution protrusion 123 and an injection speed thereof is initially delayed. The mixture gas spreads and flows in all directions along the end of the distribution protrusion 123.

The mixture gas flowing along the end of the distribution protrusion 123 collides with the connection guide 124 and the injection speed thereof is further delayed. The mixture gas experiences frictional force while running over the connection guide 124, thereby forming equal flow distribution.

On the other hand, the mixture gas injected through the first mixture pipe 113 may rapidly flow toward burner ports relatively farther from the first mixture pipe 113 due to an interaction with the mixture gas colliding with the distribution protrusion 123 and the connection guide 124 and then reflected therefrom.

According to the action as described above, an effect caused by a difference of distances between the first mixture pipe 113 and the burner ports may be compensated for, and the mixture gas may be equally discharged from the plurality of burner ports.

In the case of a flow of the mixture gas in the second burner 20, the mixture gas in the second mixture pipe 211 is discharged toward the outside of the second burner 20 through the plurality of third burner ports 214 of the supporting wall 213. The mixture gas discharged toward the outside of the second burner 20 is ignited by flames located in response to the second edge part 122*b* of the first burner cap 12 in the first burner head 11. That is, as shown in FIG. 3, since the second edge part 122*b* is closer to the second burner 20 than the first edge part 122*a* of the first burner cap 12 and the head inner wall 116 is formed in a shape corresponding to the second opening 122 of the first burner cap 12, flames of the head inner wall 116 may spread toward the second burner 20.

In the embodiment as described above, flames of the second burner 20 are generated outside the second burner 20. Alternatively, when an opening is formed in the center of the second burner cap 22, flames may be generated toward the center of the opening of the second burner cap 22.

In the present embodiment, the burner 1 includes the first burner 10 and the second burner 20. Alternatively, the burner 1 may include only the first burner 10.

According to the present embodiment, in the case of a burner cap or a burner, since a mixture gas may equally spread to a plurality of burner ports, a concentration of flames may be prevented, the mixture gas may be uniformly burned, an object for cooking may be uniformly heated, and occurrence of harmful substances may be reduced. Also, since being simply configured, a distribution protrusion and a connection guide formed on the burner cap may be applied to various shapes of burners. Accordingly, effective merits exist in design costs and efforts for a guide design.

Embodiments provide burner caps and burners.

In one embodiment, a burner cap as embodied and broadly described herein may include a cap body forming an external shape, an opening formed in a location separated from an edge of the cap body toward the center of the cap body, a distribution protrusion formed on a bottom part of the cap body, and a connection guide formed on the distribution protrusion.

In another embodiment, a burner cap as embodied and broadly described herein may include a cap body forming an external shape, a distribution protrusion protruded downwards from a bottom part of the cap body and allowing a mixture gas injected toward the bottom part to preliminary collide therewith, and a connection guide formed on the distribution protrusion and allowing the mixture gas colliding with the distribution protrusion to secondarily collide therewith.

In another embodiment, a burner as embodied and broadly described herein may include a burner head including at least one mixture pipe and a burner cap seated above the burner head. The burner cap includes a distribution protrusion disposed in a location corresponding to the mixture pipe and a connection guide formed on the distribution protrusion.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A burner cap, comprising:

a cap body;

an opening formed at a center of the cap body, separated from an edge of the cap body;

at least one distribution protrusion formed on a bottom of the cap body; and a connection guide formed along a periphery of each of the at least one distribution protrusion, wherein an edge portion of the opening includes:

a plurality of first edge portions formed closer than the at least one distribution protrusion to the center of the cap body; and a plurality of second edge portions formed farther than the plurality of first edge portions from the center of the cap body, respectively, wherein each of the at least one distribution protrusion is formed between two adjacent second edge portions of the plurality of second edge portions.

2. The burner cap according to claim 1, wherein the connection guide is continuously formed along the periphery of the at least one distribution protrusion.

3. The burner cap according to claim 1, wherein a bottom of the at least one distribution protrusion is flat, and wherein the connection guide extends vertically from the at least one distribution protrusion.

4. The burner cap according to claim 1, wherein each of the at least one distribution protrusion includes a recessed area that is recessed in an upward direction from a bottom of the at least one distribution protrusion, and wherein the connection guide is formed outside of the recessed area.

5. The burner cap according to claim 1, wherein the plurality of first edge portions and the plurality of second edge portions are alternately arranged to define a periphery of the opening.

6. The burner cap according to claim 1, wherein each of the at least one distribution protrusion is provided between one of the plurality of first edge portions and an outer edge of the bottom of the cap body.

7. The burner cap according to claim 1, wherein the plurality of second edge portions is farther from the center of the cap body than each of the at least one distribution protrusion is from the center of the cap body.

8. The burner cap according to claim 1, wherein each of the at least one distribution protrusion is substantially cylindrical, and wherein the connection guide is annular and is provided along an edge of an axial end of the at least one distribution protrusion.

9. A burner, comprising:

a burner head including at least one mixture pipe; and a burner cap seated above the burner head, wherein the burner cap includes:

at least one distribution protrusion that protrudes in a downward direction from a bottom portion of the burner cap; and a connection guide that protrudes in the downward direction from the at least one distribution protrusion, wherein the at least one distribution protrusion is provided in a location corresponding to the mixture pipe, wherein a diameter of the at least one distribution protrusion is greater than a diameter of the mixture pipe, and wherein the connection guide is continuously formed along an edge of the at least one distribution protrusion.

10. The burner according to claim 9, wherein an end of the at least one distribution protrusion is oriented perpendicular to a flow direction of a mixture gas flowing from the mixture pipe.

11. The burner according to claim 9, wherein the at least one distribution protrusion fully overlaps the mixture pipe.

12. The burner according to claim 9, wherein the burner head includes at least one fastening protrusion, and the burner cap includes at least one fastening groove that receives the at least one fastening protrusion to couple the burner cap and the burner head.

* * * * *